United States Patent [19]

Crump

[11] 4,333,677

[45] Jun. 8, 1982

[54] DEVICE FOR CARRYING AND SECURING SKIS, BOOTS AND POLES

[76] Inventor: John M. Crump, 1018 Parkridge Cir. W., Jacksonville, Fla. 32211

[21] Appl. No.: 125,340

[22] Filed: Feb. 28, 1980

[51] Int. Cl.[3] ..... A45F 5/10

[52] U.S. Cl. ..... 294/147; 294/163; 294/165

[58] Field of Search ..... 224/45 S, 45 Q, 46 R, 224/50, 917; 211/37; 280/814, 815; 294/147, 163, 165

[56] References Cited

U.S. PATENT DOCUMENTS

| | | | |
|---|---|---|---|
| 2,956,813 | 10/1960 | Madden | 224/45 S |
| 3,210,787 | 10/1965 | Allsop | 12/120.5 |
| 3,248,027 | 4/1966 | Pfleider | 224/45 S |
| 3,260,430 | 7/1966 | Sandenburgh | 224/45 S |
| 3,272,413 | 9/1966 | Pfleider | 224/45 S |
| 3,718,242 | 2/1973 | Larson | 224/45 S |
| 3,990,655 | 11/1976 | Covell | 224/45 S |
| 4,190,182 | 2/1980 | Hickey | 224/45 S |

*Primary Examiner*—Steven M. Pollard

[57] ABSTRACT

The invention is a single, integral device for carrying and/or securing any desired combination of equipment such as skis, boots and poles. The device includes a pair of cooperable retainer cradle carriages, each movably mounted onto a central structural mounting column, one of the carriage cradle modules being adapted to cooperate with a base to form a pair of ski and pole magazine chambers.

The structural mounting column is provided with a hand grasp handle at its upper extremity for holding the device during carrying. The novel configuration provides in a single device the means for carrying and/or securing skis, poles and boots. The invention has the additional novel feature of providing simultaneous means for securing, with one lock, any combination of ski equipment including skis, poles and boots. The unique physical relationship of the skis, poles and boots, while attached to the device, provides a stable, streamline and beneficial center of gravity highly conducive to user safety, compact storage and ease of handling.

9 Claims, 14 Drawing Figures

BOOT
POLE
SKI
SKI

DEVICE FOR CARRYING AND SECURING SKIS, BOOTS AND POLES

FIELD OF THE INVENTION

The present invention consists of a device for carrying and/or securing any combination of equipment such as skis, poles and boots while simultaneously providing a single, integral means for securing the complete device and any combination of equipment when a skier leaves the equipment unattended in a ski resort, public area, or any place where convenience and security are desired.

DESCRIPTION OF PRIOR ART

Heretofore, skis, poles and boots were carried separately and no means existed whereby any combination of skis, poles and boots could be carried and/or secured by one single integral device. The applicant has disclosed another embodiment of the subject invention in application Ser. No. 06/057,306 filed July 13, 1979.

The conventional techniques for carrying and handling ski equipment encompasses a wide range of diverse, cumbersome, awkward and clumsy combinations of positions relative to the skier's capacity for maintaining a hand grasp onto the unwieldly equipment.

There are no known devices which will simultaneously provide, in one integral device, the means for both carrying and/or securing any desired combination of skis, poles and boots. A device for carrying boots has been disclosed, for example, in U.S. Pat. No. 3,210,787 by Allsop. A device for carrying skis and poles has been disclosed, for example in U.S. Pat. No. 3,990,655 by Covell. Each of these prior devices are limited to their independent uses. Therefore, there is a definite need for a single, integral device which will accomplish both carry and/or security means for not only skis and poles but skis, poles and boots or any combination thereof.

OBJECTS AND SUMMARY OF THE INVENTION

Accordingly, in view of the foregoing factors and conditions characteristic of the prior art, it is a primary object of the present invention to provide a single device for carrying and/or securing any desired combination of boots, skis and poles.

It is another object of the present invention to provide a single compact and unitary device that is economically designed, easily assembled, simple to utilize, lightweight with structural integrity, and constructable using a variety of selected materials and/or fabrication techniques.

Another object of the present invention is the remedying in a single economical design many of the hazards and dangers associated with the manual transporting of ski equipment at ski resort areas under slippery conditions, thus leaving one hand free to hold onto handrails or otherwise prevent falls or catch oneself during a fall.

Yet another object of the present invention is to provide a device for carrying and/or securing any combination of skis, boots and poles which will continue its intended function with or without resilient biasing means thereby providing improved structural integrity.

In accordance with the present invention, a device for carrying and/or securing any combination of skis, boots and poles embodies four main parts only, including a structural mounting column with handle and base, an upper cradle carriage, a lower cradle carriage—ski and pole magazine and a single adjustable securing means. Thus, the device is comprised of a central structural column having threaded surfaces cooperating with an adjustable securing means detachably mounted thereon, a pair of cradle carriages movably mounted for vertical motion relative to each other and to the structural column. One of the cradle carriages is formed integrally with a ski and pole magazine body part being shaped and related to each other in such a manner as to insure cooperation with both boots, a pair of skis and a pair of poles, each held in position and free of looseness relative to one another by either/or both resilient biasing means and adjustable securing means. The arrangement is such that the device may be loaded with any combination of boots, skis and poles and will retain and secure this equipment in substantially the same reliable manner regardless of the combination of equipment loaded therewith.

The features of the present invention, which are considered novel, are set forth with specificity in the following specifications, appended claims and illustrated in the accompanying drawings, which disclose, by way of example, the principle of the invention and preferred mode contemplated of applying that principle.

DESCRIPTION OF THE PREFERRED EMBODIMENTS

Figure 1:
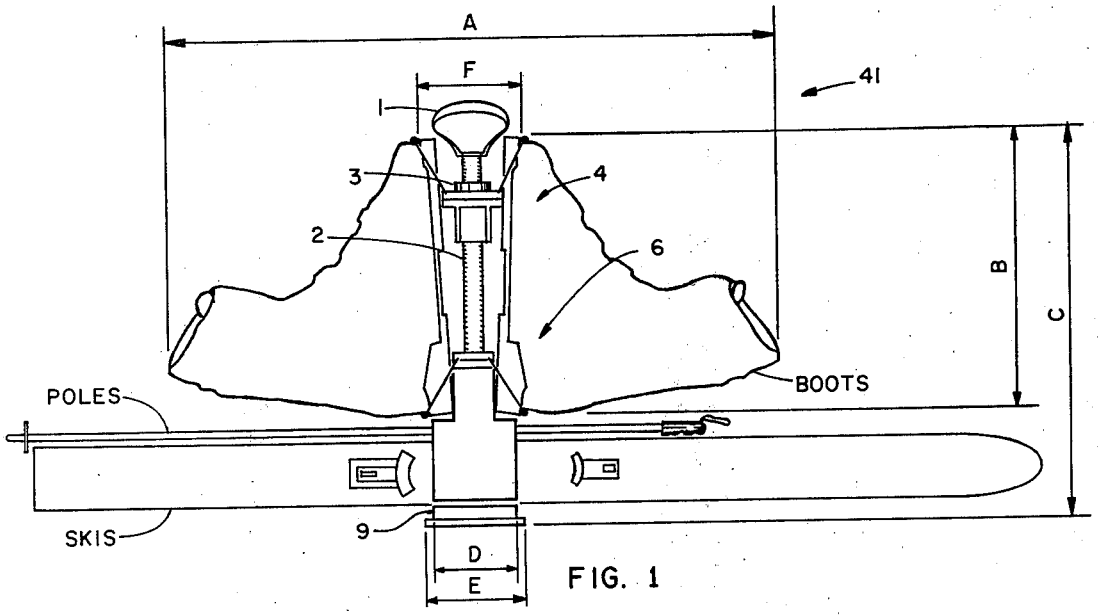
FIG. 1 is a profile view of the device for carrying and securing skis, poles and boots.

The preferred embodiments of the present invention may be best illustrated by reference to FIG. 1 wherein a device 41 is shown for carrying and/or securing skis, poles and boots. While the device 41 may be constructed from any suitable material, including wood, the preferred material, based upon present technological and economic conditions, is plastic. Therefore, the shaping and synthesizing of parts has been influenced by the contemplated selection of construction materials while at the same time not compromising the novel features of the invention. Furthermore, the position of the boots may be reversed such that the boot toe is down and the heel is up without changing the basic novel features of the invention.

Thus, a device 41, constructed of plastic materials, includes a central structural mounting column 2 terminating at the top with hand grasp 1 contained within dimension F and terminating at the bottom with base 9 having dimensions D and E. Cooperating with column 2 is an upper cradle carriage 4 slidably secured for vertical movement relative thereto such that boot dimension B may be accommodated. Also, cooperting with cradle carriage 4 is a lower cradle carriage—ski and pole magazine member 6 slidably secured for vertical movement relative to column 2 such that skis and poles may be accommodated therewith.

Figure 4:
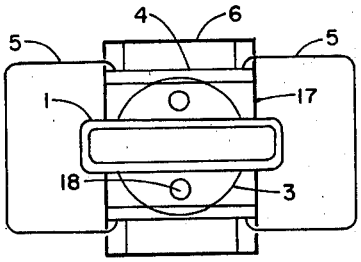
FIG. 4 is a top plan view.

Following the engagement of boots, skis and poles with device 41 threadable adjustable securing means 3 may then be adjusted down upon top surface of carriage 4. A locking cable (not shown) may now be passed through aperature 18 communicating with carriage 4 as best shown in FIG. 4. The cooperative consequence of the above resulting in a device 41 with dimensions A and C for carrying and/or securing any desired combination of skis, poles and boots.

Figure 3:
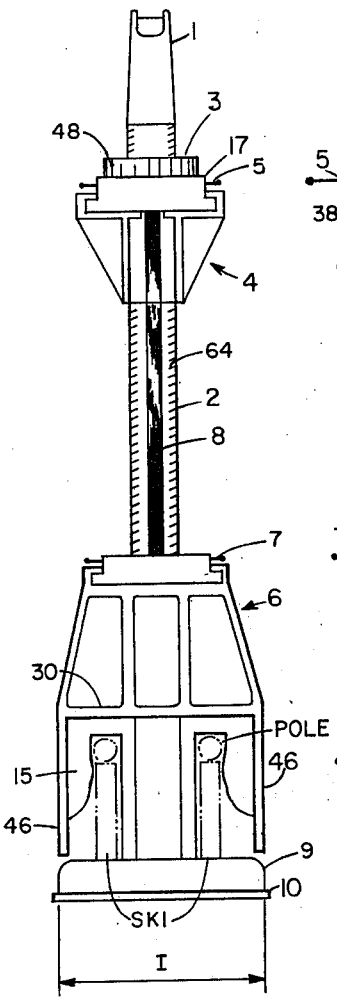
FIG. 3 is an enlarged end view of the device shown in FIG. 1.
Figure 2:
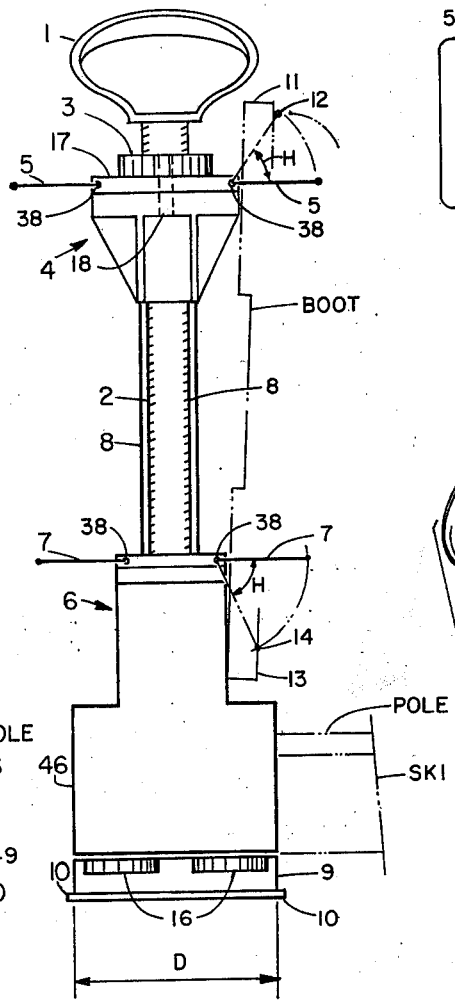
FIG. 2 is an enlarged side view of the device shown in FIG. 1.
Figure 11:
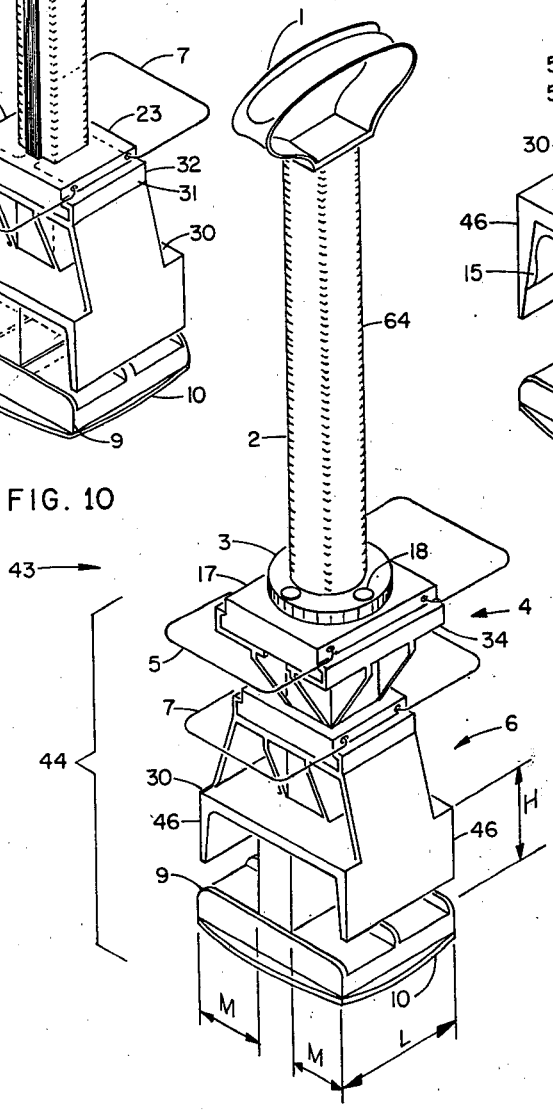
FIG. 11 is a perspective view of the device in FIG. 10 shown in the retracted position for carrying and securing skis and poles.

In FIGS. 2 and 3 the upper cradle carriage 4 and lower cradle carriage—ski and pole magazine 6 are shown slidably mounted on a central column 2 for axial movement relative to one another. Resilient restoring means 8 provide for biasing carriages 4 and 6 in a direction to restore the carriages 4 and 6 to a normal or rest position as shown in FIG. 11. The rest position is defined as that position of carriage 4 at rest upon carriage 6 and carriage 6 at rest with the base 9. Each of carriages 4 and 6 have disposed therewith an opposed pair of retainers 5 and 7 respectively. For illustration, retainer 7 is shown cradled over boot heel 13 at location 14 and retainer 5 cradled over boot toe 11 at location 12. The positions of boot heel 13 and boot toe 11 may be reversed since the device 41 will accommodate the boots in either position.

Observe in FIG. 3 that extending downwardly from, and integral with the lower cradle carriage 6, are a pair of parallel, substantially similar, symmetrical disposed side walls 46. Said walls 46 cause a ski and pole magazine chamber to be formed on both sides of centrally located structural mounting column 2 immediately above structural base 9. The outer surfaces of walls 46 are generally flushed with the outer edges of base 9 corresponding substantially with dimension I in FIG. 3 and dimension D in FIG. 2.

Figures 6, 7, 8, 9:
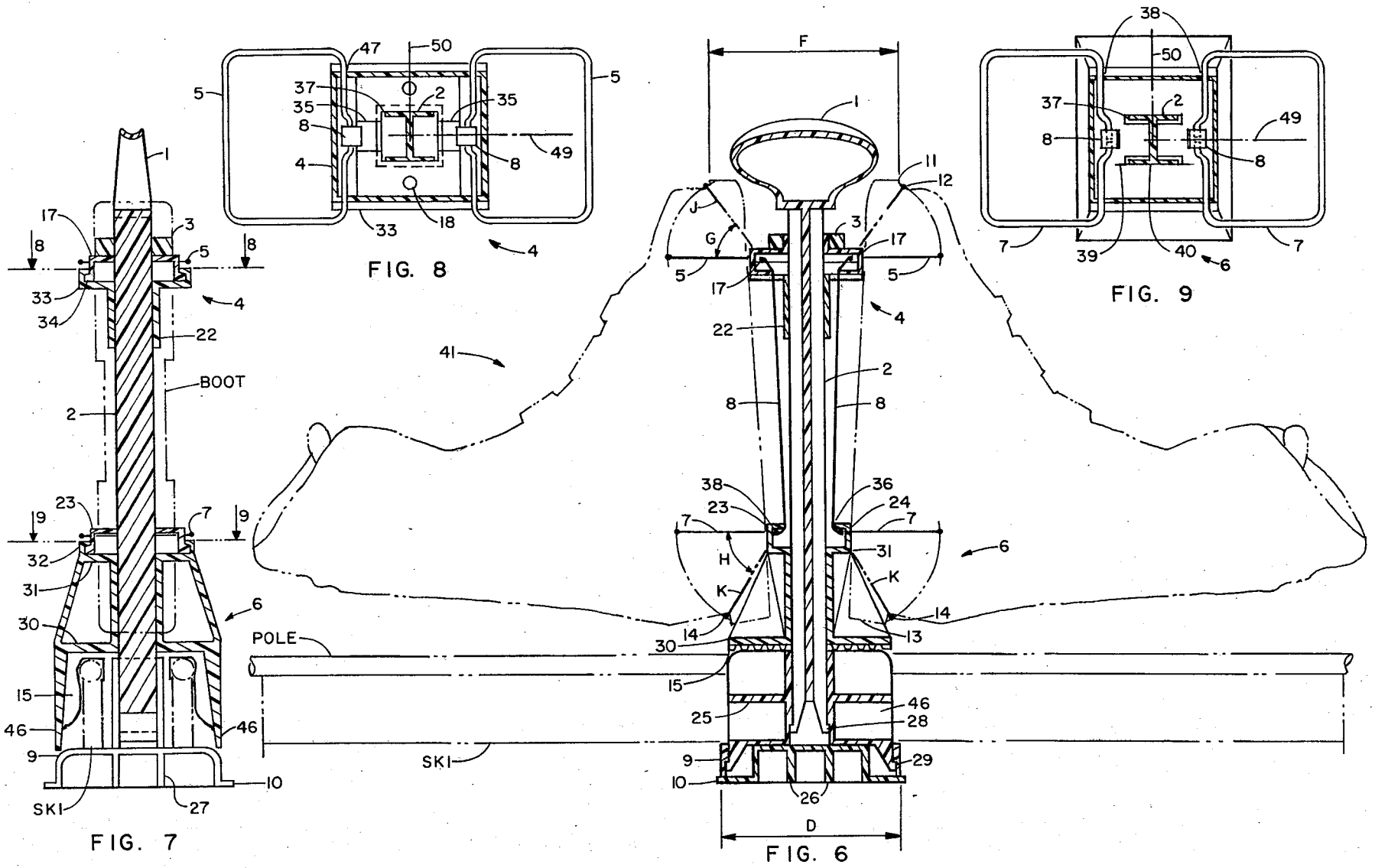
FIG. 6 is a cross-sectional side view of the device shown in FIG. 1.
FIG. 7 is a cross-sectional end view of the device shown in FIG. 1
FIG. 8 is a cross-sectional view taken on the line 8—8 of FIG. 7.
FIG. 9 is a cross-sectional view taken on the line 9—9 of FIG. 7.

As shown on FIGS. 2 and 6, the boot heel lug 13 is releasably secured at location 14 by retainer 7 which is rotatably mounted at pivot connection means 38. When not engaged with boot lug 13 retainer 7 is normally biased into a position H of approximately 45 degrees from a horizontal plane. However, retainer 7 may be positioned at any angle generally designated as angle limits H. After boot lug 13 is initially engaged with retainer 7 gravitational force causes retainer 7 to assume position 14 exerting a force on retainer 7 along K thereby causing boot sole to rest horizontally upon carriage 6 generally at location 24. Subsequent to the engagement of boot lug 11 with retainer 5 generally at position 12 thereby places the boot in stable carrying engagement with device 41. Resilient biasing means 8 provides an auxiliary means for urging retainers 5 into a position normally in the angular range designated by G. This biasing action also applies an additional force urging carriage 4 and 6 toward one another thereby firmly holding boots with device 41. Locking means 3 may now be adjusted by thread means downwardly and axially along column 2 into contact with top part 17 of carriage 4 thereby securing boots with device 41.

The structural formation shown in FIG. 4 includes multiple aperatures 18 communicating through adjustable securing means 3. Cooperating with aperatures 18 are aperatures through upper cradle carriage 4 whereby a locking cable (not shown) can be passed therethrough, thereby preventing the adjustment of means 3 relative to carriage 4 thus providing the consequential means for locking device 41.

Figure 5:
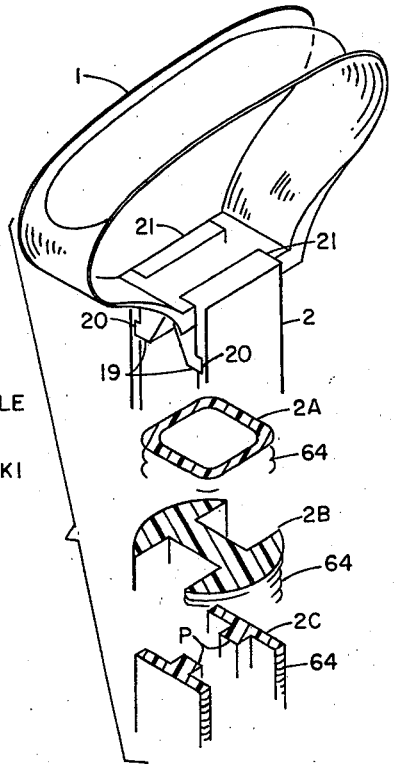
FIG. 5 is a partial perspective view showing the hand grasp attachment to the structural mounting column.

To provide for the slidable installation of cradle carriages 4 and 6, onto column 2, a detachable hand grasp 1 is shown in FIG. 5. Shear keys 19 are interlocked into shear recesses 20 with the upper extremity 21 of column 2 cooperating with a pair of symmetrical opposed grooves in handle 1. Without attempting to limit the particular fabrication techniques, but in the interest of informing the public of preferred methods by way of example, it will be observed in FIG. 6 that the hand grasp carrying means 1 may be constructed integrally with structural column 2 with a detachable connection made at the lower extremity by means of shear key type fasteners 28 and/or 29. Variations of Column 2 cross-section are identified by reference 2A, 2B and 2C. Adjustment means are identified by reference 64.

The embodiment of device 41, illustrated in FIG. 6, is shown accommodating boots, poles and skis. A pair of boot retainers 7 diametrically opposed and adjusted to releasable cradle over boot sole lugs at 14, are rotatively connected to the top part of lower cradle carriage 23 at slots 38. Each boot retainer is connected to a variable length resilient biasing means 8. Retainers 7 may assume a normal position of angular deflection H which in cooperation with angular deflection G of a pair of boot retainers 5 results in the consequential securement of boots with device 41. Retainers 5 are rotatively connected to the top part 17 of upper cradle carriage 4 similar to that described for retainers 7. The central portion of adjustable securing means 3 is threadably engaged with structural mounting column 2. Preferably, the outer peripheral surface of the means 3 is knurled or roughened, as seen at surface 48 in FIG. 3, in order to facilitate adjustment. Normal adjustment of means 3 would require relatively short axial distance along Column 2.

As previously described the lower cradle carriage 6 is generally rectangular in configuration having a pair of outer downwardly depending walls or skirts 46, which in cooperation with member 30, base 9, and column 2, cause ski and pole magazine chambers to be formed as shown. The inside surfaces of the ski and pole magazine chambers may be covered with resilient material 15 to prevent damage to ski and pole surfaces. Unlike prior art the present invention does not depend upon resilient biasing means for structural integrity. Thus the device 41, illustrated in FIG. 6, will continue to function satisfactorily even without resilient biasing means 8.

Based upon my experience with the device 41, and engineering considerations of concurrent forces J and K referenced in FIG. 6, with a resultant force action causing boots to be translated downwardly, I am able to set forth certain methods of operation. First, since both the upper cradle carriage 4 and the lower cradle carriage—ski and pole magazine 6 are slidably mounted on column 2, it follows that with boots, skis and poles secured with device 41, as illustrated in FIG. 6, they will remain secured therewith even without resilient biasing means 8.

Secondly, in the event only skis and poles are secured with device 41, the same desirable features hold true. That is, the equipment will remain secured with device 41 without resilient biasing means 8.

Thirdly, this same desirable feature holds true when only boots are secured with device 41. Dimension D of base 9 may conform to certain conventional standards suitble for cooperating with sales display racks and certain storage racks as may be provided in private residences and public places in conjunction with ski resorts, for example.

Referring to FIG. 7, there is illustrated more clearly the ski and pole magazines being generally formed by downwardly depending side walls or skirts 46, base 9, top member 30 and central column 2. The ski and pole magazines are opened by manual movement of cradle carriage 6 in an upwardly direction thereby allowing for easy installation or removal of skis and poles. Following the installation of skis and poles the cradle carriage 6 is moved downwardly thereby resulting in the consequential securement of skis and poles with device 41. Reinforcing ribs 27 may be formed as part of a unitary base molded from suitable plastic material and being generally located for cooperation with other features of the device 41 such as a deck for skis to rest upon and a platform to set the device 41 down upon.

In order to permit loading and unloading of equipment with device 41, it has been illustrated that carriages 4 and 6 are slidable mounted on Column 2. FIGS. 8 and 9 respectively show a method of centrally locating column 2 for cooperation with carriages 4 and 6. Column 2, having geometric center at intersection of centerlines 49 and 50, may preferrably be of any geometric shape including circular, rectangular and polygons since each of these shapes will provide at least three surface portions 37 equidistant from a fixed point called the geometric center of column 2. Surface sections 37 correspond with column 2 threaded surfaces 64 referenced in FIG. 5. Said surface sections 37 thus provide for threadable engagement with adjustable securing means 3.

The surfaces 37 determine a circle corresponding to the inside threaded diameter of securing means 3 and circumscribed about the structural column 2 which may be generally shaped to satisfy structural strength, alignment, and sliding surface 40 requirements of carriages 4 and 6. As shown in FIG. 5, reference 2C, column 2 may even be fabricated in two sections with a slot communicated between.

Figure 10:
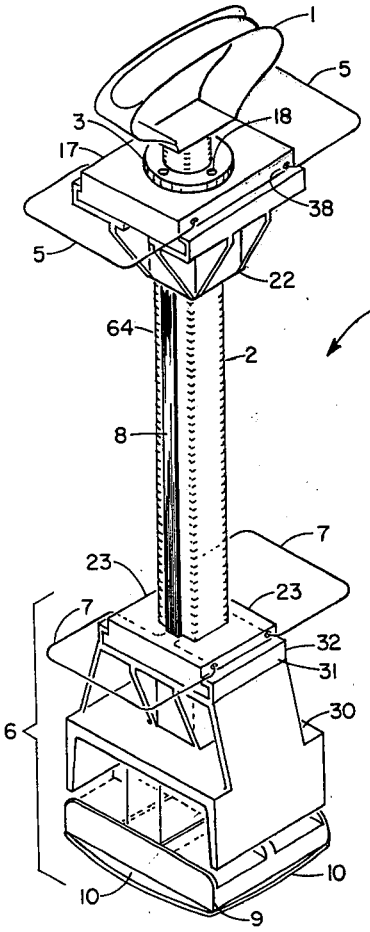
FIG. 10 is a perspective view of a device for carrying and securing skis, poles and boots shown in the extended position.

Turning now to FIG. 10, there is illustrated device 42 with upper cradle carriage 4 raised to its extended upwardly position ready to receive boots for securement therewith. Lower cradle carriage 6 is shown in its normal down position and may, as desired, have secured therewith skis and poles. Comparing FIG. 6 with FIG. 10, observe that boot lug 13 is engaged with retainer 7, then boot lug 11 is engaged with retainer 5 and then securing/locking means 3 is adjusted down onto contact with top surface 17 of carriage 4. FIG. 11 illustrates device 43 with assemblage 44 comprised of carriages 4 and 6 both in the retracted or normally down position. The entire assemblage 44 may be manually raised upward by lifting up on carriage 6 thereby exposing ski magazines M ready for installation of skis and poles parallel with dimension L. To lock and secure device 43 the adjustable locking means 3 is adjusted down until contact is made with the top part 17 of carriage 4 whereupon a lock may be put through aperture 18 thereby locking device 43.

Figure 12:
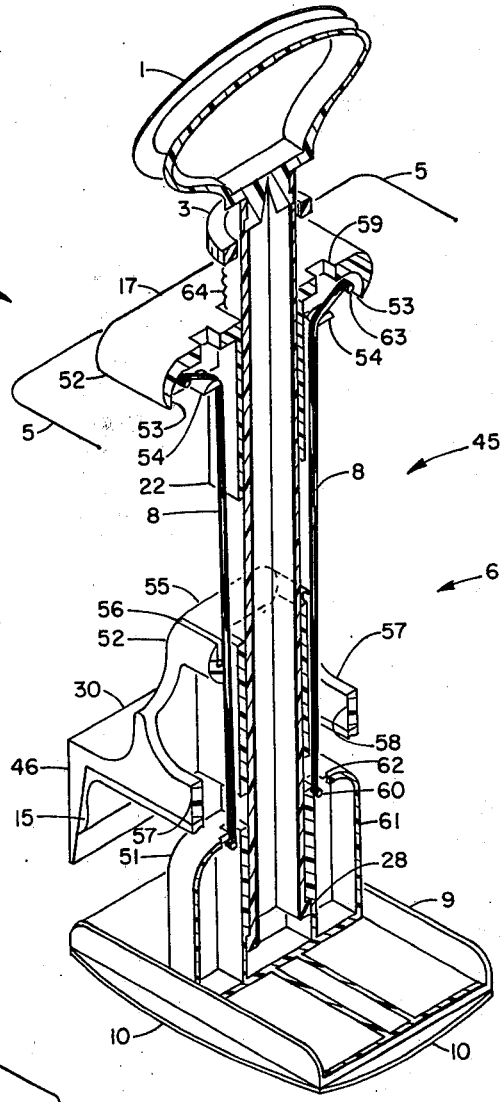
FIG. 12 is a cross-sectional perspective view.

Coming now to FIG. 12 there is illustrated in perspective cross-section an embodiment of the invention containing easily mountable, self-contained cradle carriage 4 having variable length resilient biasing means 8 interconnected with upper part 51 of base 9 at fastener means 60. The carriages 4 and 6 are slidable mounted on column 2. To complete the teaching and the disclosure, it should be observed that rotatable retainers 7 are optional parts on carriage 6 since the boot lug retainers 57 are molded integral with member 30.

Figure 13:
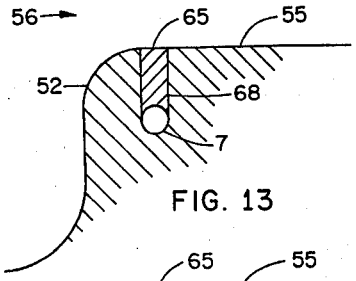
Figure 14:
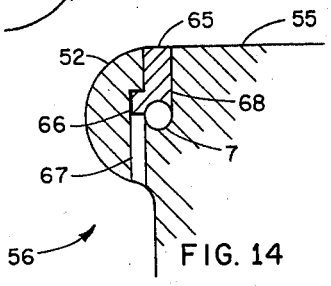

Therefore, a mounting means 56 is provided rearward of boot rest surface 52 comprised of a longitudinal slot for retainer 7 and removable keeper means 65 as shown in FIG. 13. FIG. 14 illustrates the shear tongue 77 for retention of keeper 65 in slot 68. Multiple individual shear tongues 66 may be located at selected locations along the longitudinal length of slot 68. Slot 67 is provided to assist in molding the recess for part 66. It can be appreciated that the novel features of device 45, associated with an integrally molded boot lug retainer 57 with optional retainer 7 mounting means 56, will provide simple means for accommodating not only all standard commercially available boots but non-standard boots also.

While the above description contains many specificities, these should not be construed as limitations on the scope of the invention, but rather as an examplification of preferred embodiments thereof. Many other variations are possible; for example, providing fixed boot retainers on the lower cradle carriage 6 by molding upwardly extending walls from surface 30 to a height sufficiently for securing boot sole point 14 as best envisioned in FIG. 6. Another example includes an embodiment wherein resilient means 8 has its lower extremity connected to the structural column wall in the vicinity of reinforcing rib 25 as best envisioned in FIG. 6. Yet other variations rest with the construction of structural column 2 including its cross-sectional shape, methods of attaching the hand grasp 1 and/or methods of attaching to the base 9. It is possible to construct column 2 integral with base 9 thereby eliminating need for fastening joint 28. Hand grasp 1 may be constructed integral with column 2, thereby requiring a fastening joint in vicinity of 28 or 29 as best envisioned in FIG. 6.

From FIG. 11 observe that column 2 may be constructed to telescopically cooperate with assemblage 44, thereby allowing hand grasp 1 to be lower during carrying and securing of skis and poles without boots. In FIG. 12 parts 17 and 34 may be molded integral as a single part. Similarly, parts 23 and 31 may be molded integral as a single part.

In addition, the entire device may be constructed from formed wire utilizing a skeletonized technique. The structural column may be constructed of tubular aluminum with the remaining parts molded from plastic materials.

Resilient biasing means of the compression spring type may be installed internal to column 2 and located between the lower part of hand grasp 1 and the top part 17 of carriage 4. Of course, a tension-type spring may be installed internally to column 2 and located between the base 9 and top 17 of carriage 4.

Column 2 may be constructed for telescopic cooperation with base 9. A shoulder carrying strap may be installed for retraction into column 2. Furthermore, column 2 may be constructed with a slot communicating through it thereby allowing for a single resilient means 8 to be located internal to the column 2. Retainers 5 and 7 may be self-biasing by constructing the terminal ends such that they cause the retainer to function as a torsion spring thus causing the retainers 5 and 7 to have a memory of normal desired position. Lower carriage part 30 may be constructed concavely in vicinity of poles thereby providing a more favorable mating posture.

In FIG. 6 observe that dimension F may be increased thereby allowing hand grasp 1 to be lowered. In FIG. 7 observe that the ski and pole magazine parts 30 and 46 may be contoured to mate with the pole surfaces.

In all of these variations the fundamental novel features of the invention 41 are retained whereby any desired combination of boots, skis and poles may be carried and/or secured therewith.

Having described the construction and relation of the parts in most respects, including variations, a description will be given of the operation and functioning of device 41 in a typical ski equipment utilization environment.

METHODS OF OPERATION

In FIG. 11 device 43 illustrates the generally normal posture of device 41 when skis, poles and boots are not secured therewith. Carriage members 4 and 6 are in their most extreme downwardly position as indicated by assemblage notation 44.

Operational Mode No. 1: Device 43 used to carry skis and poles without boots. With reference to FIG. 11 the securing means 3 is adjusted up column 2 thereby allowing carriage assemblage 44 to be moved upward about column 2 thus exposing the ski and pole magazines identified by dimensions M, L and H. Skis and poles are now installed into the magazines M resting along base dimension L. Carriage assemblage 44 is now lowered downward causing ski magazine slide skirts 46 to secure the skis and poles to column 2 and base 9. Securing means 3 may now be adjusted down onto contact with top part 17 of carriage 4 thus securing the device and its contents. A cable lock (not shown) may be installed through opening 18 thereby locking device 43.

Operational Mode No. 2: Device 42 used to carry boots without skis and poles. With reference to FIG. 10, securing means 3 is adjusted upwardly to its extreme up position thereby allowing carriage member 4 to be moved upwardly about column 2 thus causing the device 42 to be ready for installation of boot soles into retainers 5 and 7. Upon such installation the carriage 4 is released whereupon the boots are secured with device 42. Securing means 3 may now be adjusted downwardly into contact with top surface 17 of carriage 4 preventing any further upwardly movement of carriage 4 until so released by the user. A cable lock (not shown) may be installed through opening 18 thereby locking device 42.

Operational Mode No. 3: Device 42 used to carry boots, skis and poles. With reference to FIG. 12, securing means 3 is adjusted upwardly to position shown in FIG. 10. Skis and poles are now installed in the device 43 as described heretofore for Operational Mode No. 1. Carriage member 4 is now moved upwardly to the position shown in FIG. 10 and the boots secured therewith as described under Operational Mode No. 2. Securing means 3 may now be adjusted with the fingers downwardly into contact with top surface 17 of carriage member 17 preventing any further upwardly movement of carriage 4 until so released by the user. A locking cable (not shown) may be inserted through opening 18, thereby locking device 42.

Operational Mode No. 4: Device 42 used for commercial display in racks with or without boots.

Operational Mode No. 5: Device 41 used for commercial display of complete set of equipment including skis, poles and boots.

Operational Mode No. 6: Device 41 used to store or otherwise secure equipment while unattended at public and/or residential buildings.

Operational Mode No. 7: Device 41 used to secure equipment with vehicle transport racks.

Operational Mode No. 8: Device 41 utilized with or without a protective covering for transport of equipment by means of air and/or surface transportation.

Although the present invention Device 41, has been illustrated and described herein for use in carrying and securing ski equipment, it is evident from a broader standpoint, that the purpose of device 41 is to carry and secure equipment of the nature illustrated whether it be ski equipment, hunting equipment, fishing equipment, mountain climbing equipment, industrial safety equipment, or some form of special tools and equipment associated with a particular job specialty. It should be understood, therefore, that it is not intended to limit the principles of the present invention to ski equipment alone, but rather to equipment according to the utilization principles of the present invention for various other uses, all of which are fully contemplated according to the present invention.

Coming now to the advantages of the present invention and, thus, according to the principles of the device 41, a unique means for carrying and securing ski equipment is obtained. First, the capability of carrying and securing skis, poles and boots in a single device.

Secondly, the capability of carrying and securing skis and poles without boots in the same device, or boots without skis and poles.

Thirdly, virtually foolproof adjustment means due to the simplicity thereof.

Fourth, trouble-free service assured for repeated operation and usage.

Fifth, enhanced safety to both user and others because device 41 allows the equipment to be conveyed with its center of gravity below the users center of gravity thereby creating ultimate stability under conditions otherwise extremely hazardous.

Sixth, equipment may be stored in one single device having attractive, streamlined posture profile for convenient placement not otherwise possible.

Seventh, this single device achieves what conventionally cannot be achieved in two separate devices since the commercially available boot tree does not provide securing means. Moreover, this is achieved by using a device 41 whose geometric size is substantially equivalent to the simplest of the only known commercially available boot tree.

ADJUSTABLE LOCKING MEANS

It has been pointed out that one of the objects of this invention was to provide in one single device the functional characteristics of carrying and securing simultaneously not only poles, and skis but also boots while maintaining the optional feature of carrying and securing any combination of equipment. Such a structure in one form has been shown in FIGS. 1, 2, 3, 6, 7, 10, 11 and 12.

Wherein column 2 carries an axially engaged boot retainer carriage 4 (upper body portion) comprised of basic elements 5 and 17 which are further cooperatively engaged with one another. The carriage 4 has two similar oppositely disposed projections which are generally integumental to the boot toe configuration. A central column 2, with adjusting and locking member 3 threadably engaged and movably installed therewith, is formed substantially centrally of the oppositely disposed retainers 5. These boot retainers 5 may be formed integral with the main body of 22 substantially as shown in FIG. 12, or may be arcuately skeletonized using metal or non-metal wire. Carriage 4 movably cooperates with carriage 6, ski and pole magazines and securing means 3 by means of structural column 2 which is respectively disposed within the center of carriages 4 and 6 and each formed with extension limit mean generally at 22 and 51 shown in FIG. 12. Carriage 6 is preferably formed as a unitary body molded from a suitable plastic and being generally rectangular in configuration having a lower outer, downwardly depending, pair of skirts 46, the interior of which forms a central passage for receiving skis and poles. Consequently, the combined cooperative functions of members 4, 6, 2 and 9 provide the important features of construction necessary for compactness, simplicity, rugged, lightweight and uniquely adaptable to the device 41 of FIG. 1, device 45 of FIG. 12, device 42 of FIG. 10 and device 43 of FIG. 11.

SIZE

The improved device 41 construction discussed is particularly suitable to portable equipment such as skis, poles and boots since it permits the manufacturer of a standard compact structure having dimensions in the order of C=16 inches×D=3 inches×I=4 and of a geometric configuration whereupon its utilization results in much less space being occupied by the total equipment installed therein. It follows, therefore, that this new device construction permits the manufacturer of a simpler and less expensive device to achieve more combined functions than has heretofore been known.

Thus, it will be recognized that I have herein described and illustrated a new and improved device for carrying and securing equipment such as skis, poles and boots having special adaptation and utility in conjunction with user activities in a ski resort environment. It will also be appreciated that a convenient adjusting and locking means 3 is provided for ease and simplicity of operation. The locking means 3 is simple, readily engaged and disengaged, and structurally secure.

All in all, the features of my new and improved carrying and securing device bring forth an advancement in the art over prior known devices of this character while the utilization of structural components and configuration as described produce a synergistic utility effect resulting in improved life and ruggedness for a device of the character described. It will also be recognized and appreciated that the utility of the unique yet simple mechanism, particularly the parts thereof, eliminates the need for maintenance repairs and/or replacement of parts since the structural integrity does not depend upon resilient biasing means as used in prior art.

INTERCHANGEABLE EQUIPMENT RETAINERS

It has been pointed out that one of the objectives of this invention was to provide a device 41 adaptable for carrying, securing, storing and/or displaying a variety of equipment such as skis, poles and boots, such an interchangeable structure has been disclosed in FIGS. 1 through 12. When device 41 is used in posture 41 as shown in FIG. 1, boots may be communicated with equipment retainers 5 and 7 either toe up or toe down.

ADJUSTING THE EQUIPMENT CARRIAGES

In the discussion with respect to the movement of equipment carriage 4 of FIGS. 1, 2, 3, 4, 6, and 7 details were set forth for controlling the movement of these elements together with means for securing these elements in a selected setting. In its simplest functioning embodiment, the equipment carriage 4 can be adjusted up or down simply by rotating adjustment means 3 with the fingers. Observe in FIGS. 3 and 4 that the circumference of member 3 projects slightly beyond the exterior of member 2, thereby providing a convenient exposure of member 3 for ready rotation with the fingers. Similar arguments can be set forth for the adjusting of carriage 6 or assemblage 44 as shown in FIG. 11.

RESILIENT SURFACES

Another feature of this invention deals with the surfaces in contact with the equipment. FIGS. 2 and 3 illustrate yieldable or resilient surfaces 15 and 16 providing means for both protection of equipment surfaces and also adjustment means in cooperation with carriage 6, whereby a complete range of equipment sizes may be accommodated in the single standard device 41.

The lower section of carriage 6 defines a pair of horizontal passages separated by central column 2. In operation, a pair of skis or the like are installed therein. The upper section of carriage 6 defines a slightly outwardly contoured passage for installation of a pair of holes. The upper part 30 of carriage 6 is contoured for cooperative communication with the lower part 9, thereby preventing the removal of skis and poles when equipment is installed therewith. Turning now to FIGS. 1 and 3, it is further illustrated that carriage 6 cooperates with skis and poles thereby preventing the removal of skis and poles when boots are not installed therewith device 41, thus resulting in device posture 43 of FIG. 11.

STRUCTURAL AND ESTHETIC CONSTRUCTION FEATURES

With reference to FIGS. 4, 10, 11 and 12, it is seen that a generally rectangular structural configuration has been illustrated. It is, however, within the scope of this invention to provide a generally circular configuration contoured to follow the general pattern of part 3. FIG. 1 illustrates a side profile of device 41 having compact and esthetic dimensions A, B, C, D, E, and F.

With reference to FIG. 3, it should be noted that ski magazine skirts 46 may be fixed integral with base 9 and therefore carriage 6 would have its lower terminus approximately occurring at member 30.

SKELETONIZED CONSTRUCTION TECHNIQUES

Manufacturing techniques combined with materials selected for construction can influence the cosmetic appearance, weight, economy and strength of the various parts and complete assembly 41. For instance, using plastic molding techniques could result in using a variety of ribs and open spaces merely to achieve strength, use of less materials and more efficient fabrication procedures. The utilization of metal wire forming, sometimes referred to as skeletonizing, provides an attractive manufacturing means. This technique generally requires that the wire be formed to the perimeter contour of device 41 and because of its greater strength than non-metals, a skeleton structure results rather than a solid type structure.

Engineering properties, such as shear strength, yield, tensile strength, poisson's ratio, fatigue strength, corrosion resistance, directionality are important considerations which, when considered together with the fabrication tooling techniques can have an influence upon the exterior appearance of device 41 while at the same time retaining the novel characteristics of the invention described hereinbefore. Often the outside configuration and dimensions of a part, such as device 41, are a function of its intended use and the designer has designed freedom either on the inside or the outside. The highly important choice of wall thicknesses has to be made carefully because of the ramifications involved. There are two conflicting considerations governing the initial choice of wall thickness. To obtain the maximum stiffness in a part, the choice will be the greatest wall thickness in combination with the lowest density. This is because the moment of inertia which determines stiffness and modules of elasticity, is a cube function of the thickness.

Therefore, having disclosed the synthesis and analysis of constructin features, it is understood that the fundamental novel aspects of the invention can be achieved using a variety of substitutions and changes without departing from the spirit of the invention. It is the intention, thus, to be limited only as indicated by the scope of the following claims.

Accordingly, the scope of the invention should be determined not by the embodiment illustrated, but by the appended claims and their legal equivalents, and all changes which come within the meaning and range of equivalence of the claims are therefore intended to be embraced therein.

The invention claimed is:

1. A device for the character described comprising a pair of mutually aligned and selectively manipulatable cooperative cradle carriages each slidable mounted in a predetermined relationship relative to a column member, one of said carriages having a pair of oppositely disposed downwardly depending skirts functioning in cooperation with said column member to form ski and pole magazine chambers, said column member disposed at its upper extremity with a hand grasp and at its lower extremity with a base member, said base member cooperating with said column and said skirts to form said ski and pole magazine chambers, means adjustably engaged with said column member whereby both of said carriages may be manipulated one relative to the other for selectively engaging any combination of boots, skis and poles into releasable securement therewith.

2. A device for carrying and/or securing any desired combination of equipment such as boots, skis and poles comprising in combination, a central column member, a pair of magazine chamber members movably guided by said column member for supporting a pair of skis and poles, said magazine chamber members embodying a first set of cooperable boot engaging parts disposed above and integral with said chamber member construction, a second set of symmetrically disposed cooperable boot engaging parts movably guided by said column member, securing means adjustably connected to said column member for normally remaining in a connected condition and being selectively adjustable upon manipulation relative to said column member and means disposed on said column member for carrying said device and equipment secured therewith.

3. A boot, ski and pole equipment carrying device for selectively carrying and/or securing any desired combination of said equipment, and including column means slidably guiding upper and lower carriage members for selectively receiving boot toes or boot heels for releasable containment therebetween, the lower of said carriage members having a pair of oppositely disposed skirts depending downwardly therefrom and in cooperation with said column means forming a pair of magazine chambers for receiving a pair of skis and poles, a base disposed at one terminus of said column means and a hand grasp disposed at an opposite terminus, and securing means adjustably engaged with portion of exterior surface of said column whereby the consequential operation of said carriage members and said securing means provides a device for carrying and/or securing any desired combination of boots, skis and poles.

4. Means for carrying and/or securing any desired combination of equipment, such as boots, skis and poles or the like comprising:

first means for selectably receiving for releasable retention either boot toes or boot heels and skis and poles;

second means for selectably receiving for releasable retention either boot toes or boot heels;

third means centrally located for guiding and controlling manipulative movement of said first and second means during installation and removal of said equipment;

fourth means adjustably engaged to said third means whereby further movement of said first and second means relative to said third means is prohibited;

fifth means disposed at upper terminus of said third means for carrying said device with the consequential results of securing any desired combination of said equipment theretogether.

5. In a carrying device for application to equipment such as skis, boots and poles having means for releasably securing any desired combination of said equipment in a posture such that the boot soles face one to the other parallel with and oppositely disposed to a central column member, said boot soles having their longitudinal axis perpendicular to the longitudinal axis of said skis and poles, a hand grasp disposed at upper terminus of said column member, and adjustable securing means engaged with portions of external surface of said column having internal thread means which taper transversely to the axis of said securing means and engaging said external surface of said column, said thread means cooperating to move said securing means axially on said column in response to relative rotation thereof, and locking means for releasably fastening said securing means thereby prohibiting the removal of said equipment from said device.

6. A boot, ski and pole carrying device comprising a centrally located elongated column member adapted at its lower terminus with a base member and at its upper terminus with a hand grasp, a pair of movable boot retaining carriages slidably guided by said column member for selectably and releasably fastening said boots, said fastening means including a plurality of oppositely disposed outwardly extending boot toe and boot heel retainers rotatively secured to said carriages, a resilient biasing means interposed between said carriages, oppositely disposed skirts downwardly extending from the lower of said retaining carriages for formation of ski and pole magazine chambers, said magazine chambers communicating axially through said lower carriage with chamber bottom formed by said base member, and means for selectably manipulating said carraiges for carrying and/or securing any desired combination of equipment such as skis, poles and boots.

7. A device for carrying and securing any desired combination of boots, skis, and poles or the like comprising, two members slidably supported for independent translatory movement relative one to the other on a centrally located column, each of said members releasably engageable with respectively boot sole toes and boot sole heels, one of said members cooperating with said column and a base means to form a pair of ski and pole magazine chambers, hand grasp means disposed at upper terminus of said column, a manipulatable securing means adjustably engaged with said column and disposed between said securing means having internal thread means which taper transversely of the axis of said securing means and engage with thread means on selected surfaces of said column, said thread means cooperating to move said securing means axially on the upper portion of said column in response to relative rotation thereof, the consequential results of operating said device providing for the carrying and/or securing any desired combination of boots, skis and poles.

8. In a method of assembling ski equipment and the like, said ski equipment being of the type comprising a pair of skis, pair of poles and pair of boots or any combination thereof with a ski carrying and securing device; the steps of: positioning a pair of skis parallel relative to one another and supported at their mid body section by a base member; a pair of poles positioned parallel relative to said skis and supported therewith; a pair of boots positioned perpendicular to and above said skis being supported by a centrally located stem member connected to said base member whereby said boot soles are parallel one to the other and separated by said stem member; retaining members movably guided on said stem members whereby said skis, boots and poles are releasable retained with said ski carrying and securing device; and performing an adjustment operation after assembling said equipment to securely retain said equipment in final assembled form.

9. Apparatus for carrying and/or securing any desired combination of ski equipment, such as skis, poles and boots or the like, comprising:

first boot and ski retention member movably guided by a centrally located stem member;

second boot retention member movably guided by said stem member;

means connected to lower terminus of said stem member for supporting said skis;

means connected to upper terminus of said stem member for carrying said equipment;

means adjustably cooperating with said stem member whereby said retention members are securely retained relative to one another;

said retention members being positioned and proportioned with respect to each other according to a method of assembling said ski equipment with said skis parallel to each other and said boots perpendicular to and above said skis.

* * * * *